US007316281B2

(12) United States Patent
Boudrare et al.

(10) Patent No.: US 7,316,281 B2
(45) Date of Patent: Jan. 8, 2008

(54) TWO-CONE DRILL BIT WITH ENHANCED STABILITY

(75) Inventors: Mohammed Boudrare, Houston, TX (US); Prabhakaran K. Centala, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 268 days.

(21) Appl. No.: 10/938,068

(22) Filed: Sep. 10, 2004

(65) Prior Publication Data

US 2006/0054361 A1 Mar. 16, 2006

(51) Int. Cl.
*E21B 10/36* (2006.01)
*E21B 10/08* (2006.01)

(52) U.S. Cl. ..... 175/331; 175/431

(58) Field of Classification Search ..... None
See application file for complete search history.

(56) References Cited

U.S. PATENT DOCUMENTS

| | | | | |
|---|---|---|---|---|
| 2,340,492 | A | | 2/1944 | Scott |
| 2,367,637 | A | | 1/1945 | Zublin |
| 3,207,241 | A | | 9/1965 | Neilson |
| 3,265,139 | A | | 8/1966 | Haden et al. |
| 3,329,222 | A | | 7/1967 | Neilson |
| 4,067,406 | A | * | 1/1978 | Garner et al. ..... 175/341 |
| 4,156,123 | A | * | 5/1979 | Fischer et al. ..... 219/121.14 |
| 4,258,807 | A | * | 3/1981 | Fischer et al. ..... 175/375 |
| 4,285,409 | A | | 8/1981 | Allen |
| 4,408,671 | A | | 10/1983 | Munson |
| 4,763,736 | A | | 8/1988 | Varel, Sr. |
| 4,953,641 | A | | 9/1990 | Pessier |
| 5,111,894 | A | | 5/1992 | Williams, Jr. |
| 5,244,050 | A | | 9/1993 | Estes |
| RE34,526 | E | | 2/1994 | Pessier |
| 5,586,612 | A | | 12/1996 | Isbell et al. |
| 5,996,713 | A | | 12/1999 | Pessier et al. |
| 6,601,660 | B1 | | 8/2003 | Xiang et al. |

FOREIGN PATENT DOCUMENTS

| | | |
|---|---|---|
| DE | 1223779 | 9/1966 |
| EP | 0 395 572 | 10/1990 |
| EP | 0395572 | 10/1990 |
| GB | 1 469 525 | 4/1977 |
| GB | 2 297 338 | 7/1996 |
| SU | 1670084 | 9/1988 |
| SU | 1745860 | 12/1989 |
| WO | 00/12860 | 3/2000 |
| WO | 00/29709 | 5/2000 |

OTHER PUBLICATIONS

Combined Search and Examination Report dated Sep. 11, 2006 for Application No. GB0518244.9 (6 pages).
Canadian Office Action dated May 1, 2006 for Application No. 2,517,761 (4 pages).
Combined Search and Examination Report dated Jan. 3, 2007 for Application No. GB0624490.9 (3 pages).

* cited by examiner

*Primary Examiner*—Frank Tsay
(74) *Attorney, Agent, or Firm*—Osha Liang LLP

(57) ABSTRACT

A two-cone drill bit that exhibits improved stability. In one embodiment, the two-cone drill bit has a first and a second roller cone arranged to have a cone separation angle between about 145 degrees and about 166 degrees. In some embodiments, the two-cone drill bit has a plurality of cutting elements arranged on the roller cones such that a bottom hole coverage greater than about 17 percent is achieved per revolution of the two-cone drill bit.

39 Claims, 4 Drawing Sheets

TWO-CONE DRILL BIT WITH ENHANCED STABILITY

BACKGROUND OF INVENTION

Roller cone bits, variously referred to as rock bits or drill bits, are used in earth drilling applications. Typically, they are used in petroleum or mining operations where the cost of drilling is significantly affected by the rate that the drill bits penetrate the various types of subterranean formations. That rate is referred to as rate of penetration ("ROP"), and is typically measured in feet per hour. There is a continual effort to optimize the design of drill bits to more rapidly drill specific formations so as to reduce these drilling costs.

Roller cone bits are characterized by having roller cones rotatably mounted on legs of a bit body. Each roller cone has an arrangement of cutting elements attached to or formed integrally with the roller cone. A roller cone bit having two cones was invented in 1908 and is the predecessor of the more common three-cone bit. Two-cone drill bits greatly improved drilling rates in the early 1900's, but were found to suffer severe near bit vibrations, which resulted in extensive damage to downhole tools. Three-cone bits gradually replaced two-cone drill bits because of an increase in stability and reduction in vibrations during drilling. Historically, the advantage maintained by two-cone drill bits is that they are generally able to drill faster than three-cone bits. Additionally, for drilling small holes, using three-cone bits, as opposed to two-cone bits, requires smaller legs that will be subjected to high loads through the roller cones, which are rotatably mounted. Two-cone drill bits are able to offer relatively larger legs for such hole sizes.

The two legs of most prior art two-cone drill bits are disposed substantially opposite of each other (i.e., 180 degrees apart) to evenly distribute the weight on bit ("WOB") while drilling. However, recently it has been found that improvements to the stability of two-cone drill bits may be made through the orientation of roller cones and/or changes in cutting structure arrangements on the roller cones.

SUMMARY OF INVENTION

In one aspect, the present invention relates to a two-cone drill bit. The two-cone drill bit includes a bit body having a connection adapted to connect to a drill string. The bit body has a first leg and a second leg formed thereon. A first roller cone is rotatably mounted on the first leg, and a second roller cone is rotatably mounted on the second leg. A plurality of cutting elements is disposed on the roller cones. The first roller cone has a cone separation angle of about 145 degrees to about 166 degrees relative to the second roller cone.

In another aspect, the present invention relates to a two-cone drill bit. The two-cone drill bit includes a bit body having a connection adapted to connect to a drill string. The bit body has a first leg and a second leg formed thereon. A first roller cone is rotatably mounted on the first leg, and a second roller cone is rotatably mounted on the second leg. A plurality of cutting elements is disposed on the roller cones. The plurality of cutting elements is arranged to provide greater than about 17 percent bottom hole coverage per revolution of the two-cone drill bit.

In another aspect, the present invention relates to a two-cone drill bit. The two-cone drill bit includes a bit body having a connection adapted to connect to a drill string. The bit body has a first leg and a second leg formed thereon. A first roller cone is rotatably mounted on the first leg, and a second roller cone is rotatably mounted on the second leg. A plurality of cutting elements is disposed on the roller cones. The plurality of cutting elements is arranged to provide greater than about 17 percent bottom hole coverage per revolution of the two-cone drill bit. The first roller cone has a cone separation angle of about 145 degrees to about 166 degrees relative to the second roller cone. At least two lug pads are disposed on opposing sides of the bit body between the first leg and second leg, and the lug pads have a radial clearance of less than about a ½ inch exists between an outer extent of the two lug pads and a gauge diameter of the two-cone drill bit.

Other aspects and advantages of the invention will be apparent from the following description and the appended claims.

DETAILED DESCRIPTION

In one or more embodiments, the present invention relates to two-cone drill bits. More specifically, the present invention relates to two-cone drill bits having improved stability.

Figure 1:
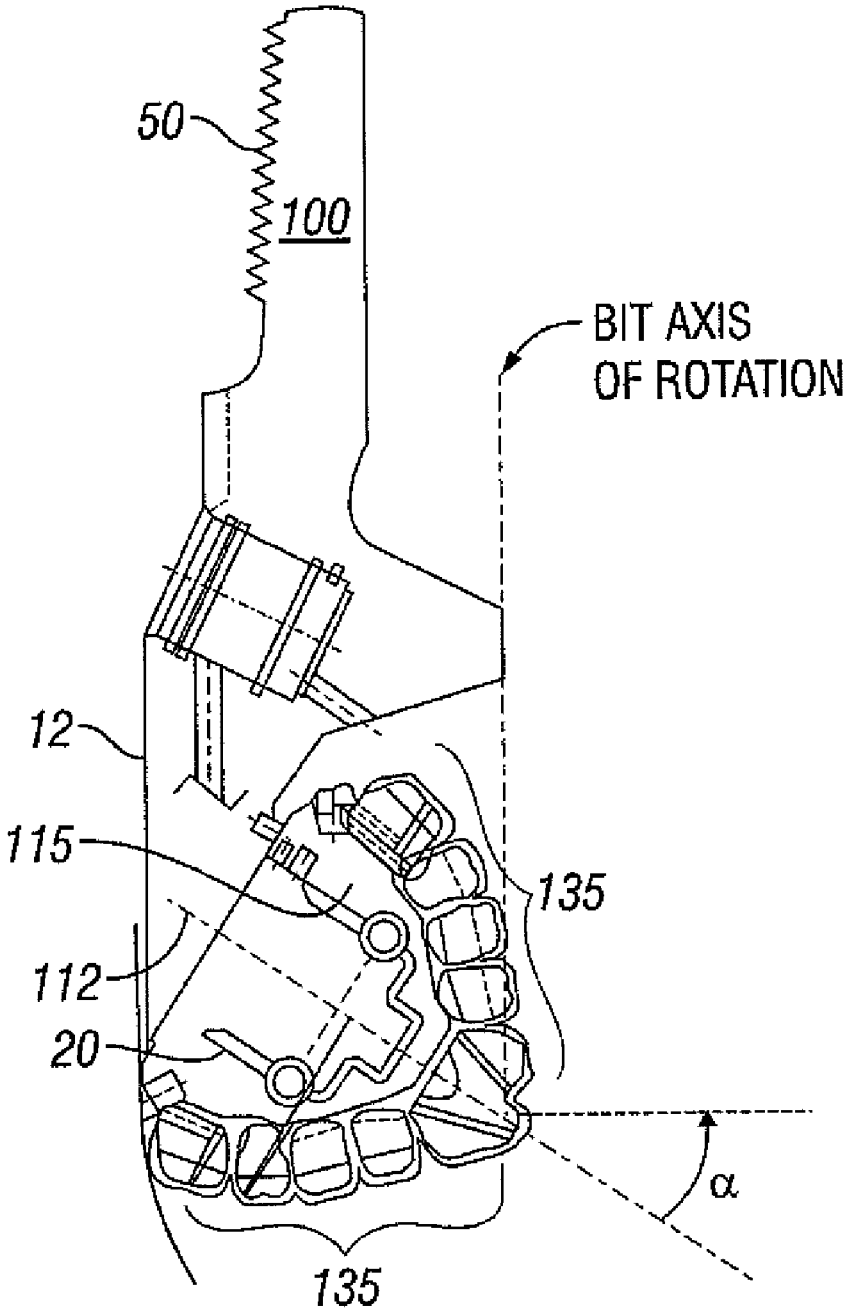
FIG. 1 (PRIOR ART)
FIG. 1 shows a cross section of a prior art drill bit.

In FIG. 1, a cross section of a prior art three-cone drill bit is shown. The portion of the drill bit that is shown includes a bit body 100 and a roller cone 115 having a plurality of cutting elements 135. A connection 50 is formed on the upper end of the bit body 100 for connection to a drill string (not shown). The roller cone 115 is rotatably mounted on a journal 20, which is disposed on a leg 12 formed on the bit body 100. During drilling, the roller cone 115 rotates about the journal axis 112. The journal axis 112 is oriented at a journal angle $\alpha$, which is typically measured relative to a horizontal line that is drawn perpendicular to the bit axis of rotation.

Figure 2:
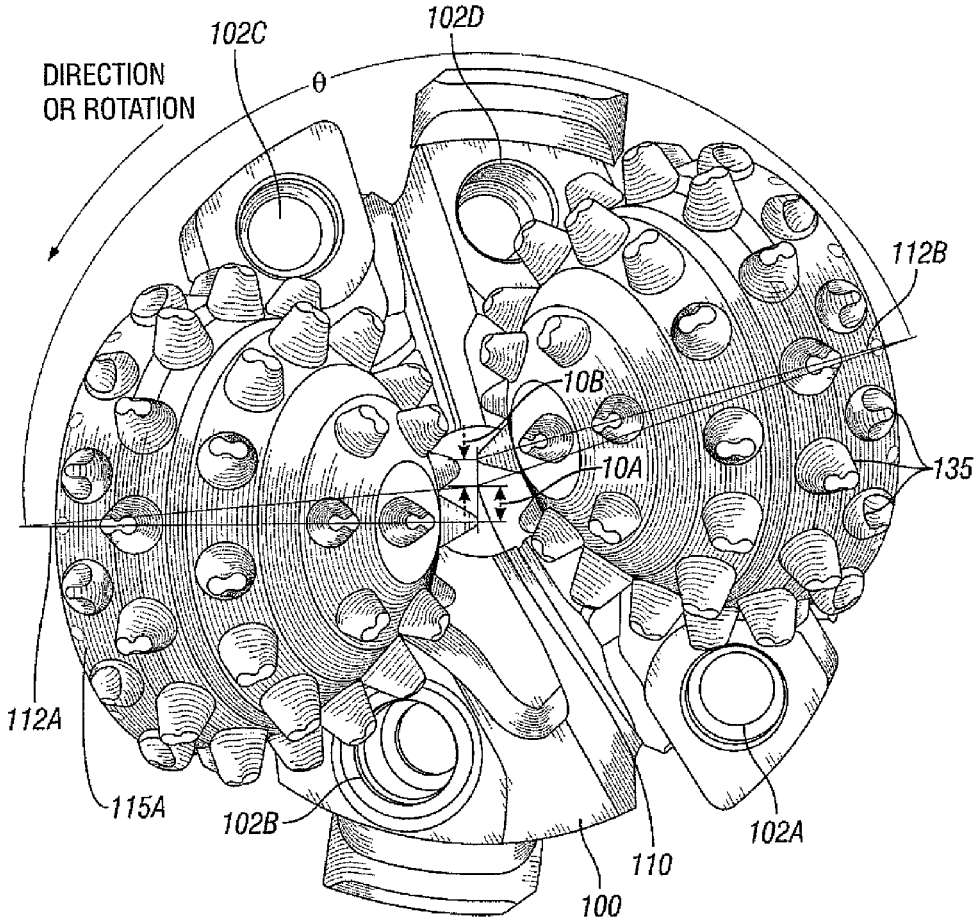
FIG. 2 shows a bottom view of a two-cone drill bit in accordance with an embodiment of the present invention.

In FIG. 2, a two-cone drill bit in accordance with one embodiment of the present invention is shown. In this embodiment, two roller cones 115A, 115B are rotatably mounted on journals (not shown) similar to that described in FIG. 1. The journal axis 112A forms a cone separation angle $\theta$ with the other journal axis 112B. As used herein, the "cone separation angle" is defined as the angle between the two journal axes 112A, 112B when projected upon a horizontal plane that is perpendicular to the center axis 110 of the drill bit. The present inventors have found that two-cone drill bits with cone separation angles $\theta$ between about 145 degrees and about 166 degrees exhibit enhanced stability while drilling. In some embodiments, a cone separation angle $\theta$ between about 155 degrees to about 165 degrees may be desired. In the particular embodiment shown in FIG. 2, a cone separation angle $\theta$ between 163 degrees and 165 degrees is used. The present inventors have discovered that arranging the cones in this manner causes the two cones to break the bottom hole sinusoidal pattern that is commonly experienced when drilling with prior art two-cone drill bits having cones opposite to each other (i.e. 180 degrees). This difference in work rate caused as a result of this range of cone separation angle as opposed to arrangements known in the prior art, provides a cutting structure arrangement for two-cone drill bit that counters or mitigates axial instability caused by the cones while drilling.

In the embodiment shown in FIG. 2, the journal axis 112A, 112B, about which each roller cone 115A, 115B rotates, is also angled slightly away from the center axis 110 of the drill bit. This is known as "cone offset." Cone offset can be determined by viewing the drill bit from the bottom on a horizontal plane that is perpendicular to the center axis 110. A positive offset is defined by an angle with the direction of rotation of the drill bit. A negative offset is defined by an angle against the direction of rotation of the drill bit. The amount of cone offset 10A, 10B is commonly measured by the minimum distance between the center axis 110 of the drill bit and the journal axis 112A, 112B when projected on the horizontal plane. In this particular embodiment, a positive cone offset 10A, 10B is shown for the roller cones 101A, 101B. In another embodiment, a combination of positive offset and negative offset (i.e. one roller cone has a positive offset and one roller cone has a negative offset) is used to improve the lateral stability of the two cone bits. The cone offset 10A, 10B forces the roller cones 115A, 115B to scrape while rolling to remove earth formation. The ratio of scraping to rolling varies based on the amount of cone offset. One skilled in the art of drill bit design would appreciate that an increase in the cone offset 10A, 10B results in an increase in scraping. The amount of cone offset is often expressed in relation to the diameter of the drill bit. For example, an embodiment of the present invention may have an offset of 1/32 inch per inch of bit diameter. One of ordinary skill in the art will appreciate that the amount of cone offset may vary for embodiments of the invention without departing from the scope of the present invention. The present inventors have discovered that for two cone bits in some embodiments a combination of offsets can bring about lateral stability during drilling, Also shown for the two-cone drill bit in FIG. 2, is a hydraulic arrangement comprising a plurality of openings (in this case four openings 102A-D). Each of the openings 102A-D may be adapted to attach a nozzle (not shown). During drilling, drilling fluid is pumped through the drill bit for several functions, including cone cleaning, cuttings removal, and bottom hole cleaning. A discussion on the hydraulics for a two-cone drill bit is provided in the co-pending application, "Two-cone Drill Bit," (Layne Larsen et al.) filed on the same day as the present invention and assigned to the assignee of the present application. That application is incorporated by reference in its entirety.

Figure 3:
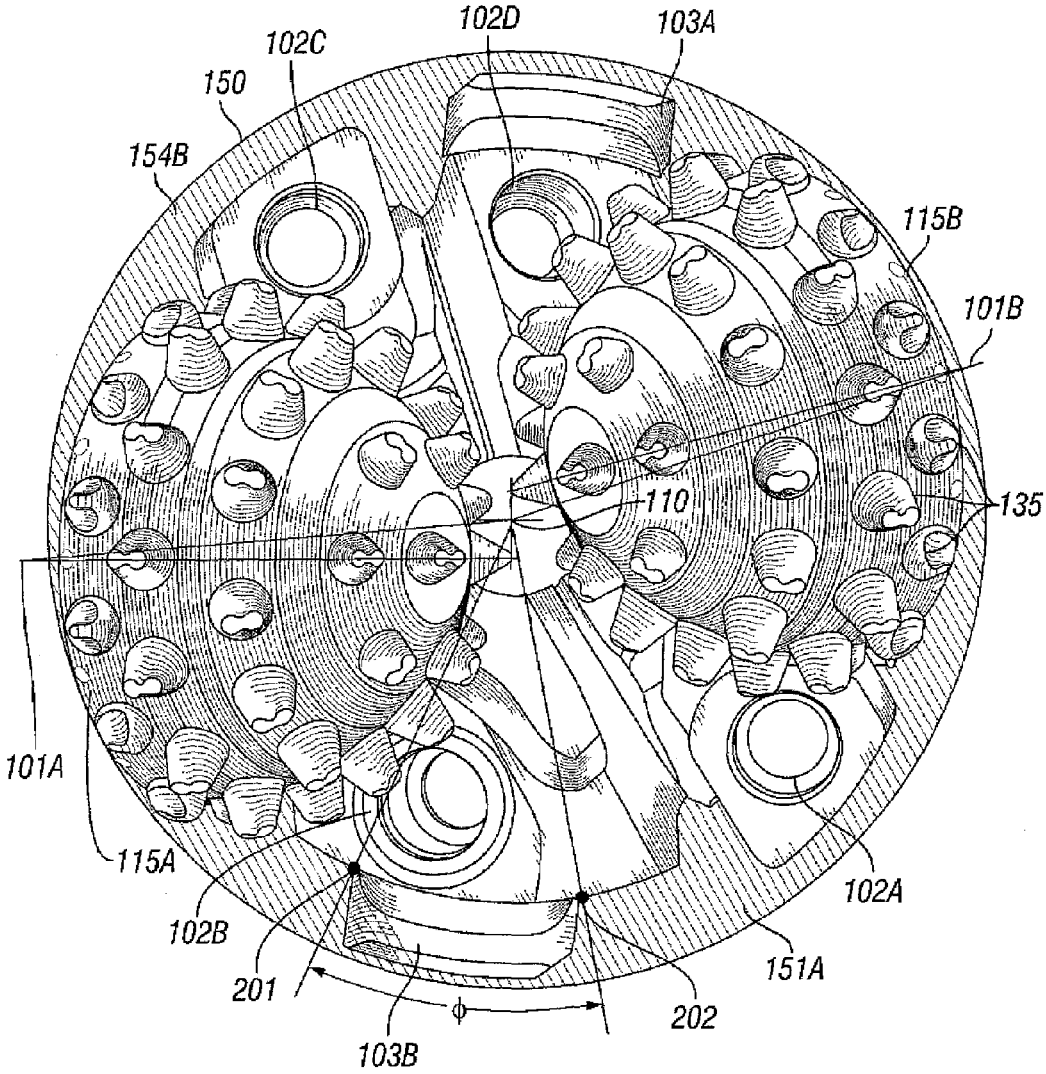
FIG. 3 shows a bottom view of a two-cone drill bit in accordance with an embodiment of the present invention.

Turning to FIG. 3, a two-cone drill bit in accordance with an embodiment of the present invention is shown. The hole wall 150 formed during drilling by the drill bit is represented by a circle, which matches the gauge diameter of the drill bit. This embodiment includes two lug pads 103A, 103B, which are disposed on opposite sides of the bit body 100. There is only a small radial clearance between the lug pads 103A, 103B and the hole wall 150. In some embodiments, the radial clearance may be as small as 1/64 inch or as large as a 1/2 inch to improve the stability of the two-cone drill bit. In other embodiments, a radial clearance between about 1/16 inch and about 1/4 inch may be used. In this particular embodiment, the radial clearance is about a 1/8 inch. It will be appreciated by those of ordinary skill in the art that smaller bits may typically have smaller clearances and larger bits may typically have larger clearances. The present inventors have found that providing a small radial clearance between the lug pads 103A, 103B and the hole wall 150 can lead to improvements in the stability of the drill bit, thus mitigating unpredicted drill string excitement to the bit that would cause the bit to initiate lateral vibrations during drilling. In some embodiments, the lug pads 103A, 103B may include an outer surface formed from a wear resistant material, such as tungsten carbide or poly-crystalline diamond (PDC). The wear resistant material may be in the form of button inserts (not shown) or as a coating on the lug pads 103A, 103B. In one embodiment, the lug pads 103A, 103B may be hardfaced using techniques known in the art, such as the use of a welding torch to harden steel.

To determine an appropriate size of the lug pads 103A, 103B, a designer should consider the annular space 151A, 151B that is available for fluid and formation cuttings to pass after exiting the drill bit. In FIG. 3, the annular space 151A, 151B is shown by the cross-hatched areas. After drilling fluid exits the drill bit through openings 102A-D, the drilling fluid must flow upward towards the surface. To do so, the drilling fluid, along with any cuttings, must pass through the annular space 151A, 151B. As is known in the art, an appropriate amount of annular space is about 15 percent to about 30 percent of the total hole area as defined by the hole wall 150.

Continuing with FIG. 3, the addition of lug pads 103A, 103B further limits the annular space 151A, 151B. The drill bit can be made more stable with larger lug pads 103A, 103B, but this reduces the amount of annular space 151A, 151B. Thus, the annular space 151A, 151B should be considered while designing the lug pads 103A, 103B. The size of the lug pads 103A, 103B may be defined using the lug angle Φ. The lug angle Φ is defined by the angle formed between the center axis 110 and the point 201 and point 202 at the location on the bit body 100 on which the lug pad 103B is disposed. For example, in one embodiment the lug angle Φ may be from about 20 degrees to about 35 degrees. While lug pads 103A, 103B are the same size in this particular embodiment, they may have different sizes in other embodiments. In general, the larger the lug angle Φ, the better for stability, however, the amount of annular space 151A, 151B limits it. One of ordinary skill in the art will appreciate that the amount of annular space 151A, 151B may vary without departing from the scope of the invention.

While only two lug pads are shown in the embodiment in FIG. 3, in other embodiments, more than two lug pads may be used. For example, two pairs of lug pads on opposing sides may be sized to have a similar amount of annular space as two larger lug pads. Further, the shape of the lug pads may vary. For example, a lug pad may vary in width from its base (i.e. where it is attached to the bit body) to its outermost extent. One of ordinary skill in the art will appreciate that the quantity and shape of the lug pads may vary without departing from the scope of the invention.

Figure 4:
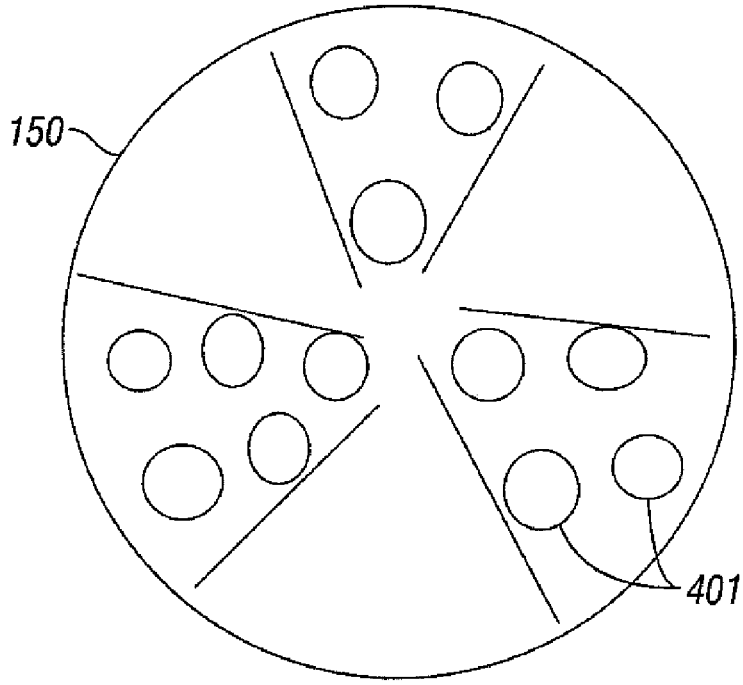
FIG. 4 (PRIOR ART)
FIG. 4 shows the contact points of a prior art three-cone drill bit.

In FIG. 4, the contact points 401 of a prior art three-cone drill bit are shown. The contact points 401 represent the cutting elements on each roller cone that may be in contact with the earth formation during drilling. The location, quantity, and size of the contact points 401 fluctuates as the drill bit rotates. Typically, the number of contact points 401 at any given moment may be substantially the same because of an even distribution of cutting elements on the roller cone.

In general, a three-cone drill bit will have about 17 percent to 25 percent bottom hole coverage. As used herein, "bottom hole coverage" refers to the percentage of bottom hole area contacted by cutting elements on the roller cones during one complete rotation of the drill bit. Bottom hole coverage is typically expressed as a percentage of the total area of the hole determined by the gauge diameter of the drill bit. The amount of bottom hole coverage varies depending on the number of contact points 401 (i.e., the number of cutting elements), as well as the ratio of roller cone revolutions to bit revolutions. The shape and orientation (e.g. journal angle and cone offset angle) of the roller cone also affect the bottom hole coverage. For example, by increasing the cone offset angle, the contact area of each contact point 401 is increased by causing the cutting element to scrape along the bottom of the hole, which increases the bottom hole coverage. One of ordinary skill in the art will appreciate that bottom hole coverage can vary depending on the physical properties (e.g. hardness) of the earth formation being drilled.

Those having ordinary skill in the art will appreciate that several methods are available for determining the number of contact points 401 and bottom hole coverage. For example, a designer may manually determine the number of contact points 401 by calculating the location of the cutting elements through all or a portion of a rotation of the drill bit. The bottom hole coverage may be determined by calculating the depth at which each cutting elements penetrates and combining that calculation with the location and quantity of the contact points 401. Drilling simulations may also be performed to determine the number of contact points 401 and bottom hole coverage. One example of a suitable drilling simulation method that may be used for this purpose is U.S. Pat. No. 6,516,293, entitled "Method for Simulating Drilling of Roller Cone Bits and its Application to Roller Cone Bit Design and Performance," which is assigned to the assignee of the present invention and now incorporated herein by reference in their entirety.

Prior art two-cone drill bits typically have a reduced number of contact points compared to three-cone drill bits because of the lower number of roller cones. The reduced number of contact points typically results in a bottom hole coverage of 11 percent to 15 percent for prior art two-cone drill bits. The present inventors have found that increasing the bottom hole coverage of a two-cone drill bit correlates to an increase in stability and a reduction of vibrations during drilling compared to prior art two-cone drill bits.

Figure 5:
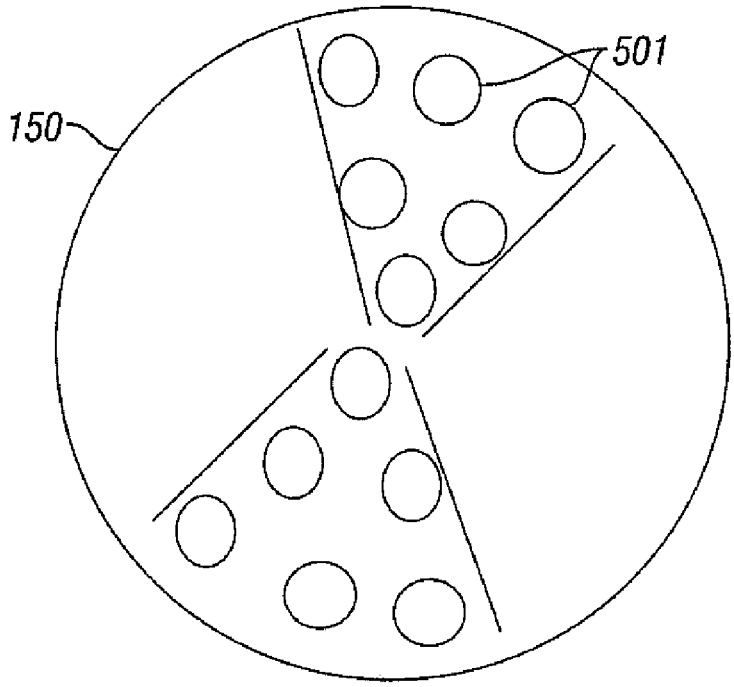
FIG. 5 shows the contact points of a two-cone drill bit in accordance with an embodiment of the present invention.

In FIG. 5, the contact points of a two-cone drill bit in accordance with an embodiment of the present invention are shown. Drill bits are typically identified using a classification system created by the International Association of Drilling Contractors (IADC). The IADC classification system is often used for comparison of drill bits. For example, to show that drill bit A performs better than drill bit B, both drill bit A and drill bit B should have the similar IADC classifications. In FIG. 5, the two-cone drill bit has a number of contact points 501 that is the same as the number of contact points 401 shown on the three-cone drill bit in FIG. 4 for a similar IADC bit type. One method for increasing the bottom hole coverage is to increase the number of contact points by increasing the number of cutting elements per roller cone. The present inventors believe that the stability of a two-cone drill bit is improved when the bottom hole coverage is greater than about 17 percent. In this particular embodiment, the bottom hole coverage is greater than about 17 percent to about 25 percent. Those having ordinary skill in the art will appreciate that the disclosed two-cone geometries are suitable for insert-type two-cone drill bits, as well as milled-tooth type two-cone drill bits.

Depending on the desired bottom hole coverage area, a drill bit designer may not be able to sufficiently increase the number of cutting elements without altering the geometry of the roller cones. In prior art roller cone drill bits, each of the roller cones partially intermesh with each other. As used herein, "intermesh" refers to the amount that the cutting elements on one roller cone extend into the gaps between cutting elements on another cone. Intermeshing roller cones provides the advantage of mechanically cleaning formation cuttings from the roller cones. The present inventors have found that a two-cone drill bit can be made without intermeshing the roller cones. Referring to FIG. 3, in one embodiment, a two-cone drill bit may have rounded roller cones that do not intermesh. By not intermeshing the roller cones, the present inventors have been able to increase the number of cutting elements disposed on each cone because there is no concern about cutting elements from the two-cones contacting each other. If improved roller cone cleaning is required due to the formation being drilled and the lack of intermesh, hydraulic arrangements, such as those disclosed in the previously referenced patent application entitled "Hydraulic Arrangement for Two-cone Drill Bits," may be used to clean the roller cones.

Embodiments of the invention may provide one or more of the following advantages. Vibrations during drilling may be reduced through improvements in the stability, both lateral and vertical, with embodiments of the invention. The reduction in vibrations helps to improve the overall life of the drill bit, as well as to reduce the occurrence of damage to other components in a drill string that may be exposed to the vibrations. Improvements in lateral stability also help to provide a more circular and straight well bore.

Two-cone drill bits in accordance with one or more embodiments of the present invention have also been found to provide improved steerability when combined with assemblies for controlling the direction of the drill bit. Further, embodiments of the invention are directionally stable when a straight hole is desired. This characteristic is improved in part because of a reduced WOB that is required for drilling the same ROP as a three-cone drill bit of a similar IADC type.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A two-cone drill bit comprising:

a bit body comprising, a connection adapted to connect to a drill string, a first leg having a first journal formed thereon, and a second leg having a second journal formed thereon;

a first roller cone rotatably mounted on the first journal;

a second roller cone rotatably mounted on the second journal, and a plurality of cutting elements disposed on the first roller cone and the second roller cone, wherein the first roller cone has a cone separation angle of about 145 degrees to about 166 degrees relative to the second roller cone, and wherein the first roller cone has a positive cone offset and the second roller cone has a negative offset.

2. The two-cone drill bit of claim 1, wherein the cone separation angle is about 155 degrees to about 165 degrees.

3. The two-cone drill bit of claim 1, wherein the cone separation angle is about 163 degrees to about 165 degrees.

4. The two-cone drill bit of claim 1, further comprising:

at least two lug pads disposed on opposing sides of the bit body between the first leg and second leg, wherein a radial clearance of less than about a ½ inch exists between an outer extent of the at least two lug pads and a gauge diameter of the two-cone drill bit.

5. The two-cone drill bit of claim 4, wherein the at least two lug pads comprise a wear resistant material selected from the group consisting of tungsten carbide, poly-crystalline diamond, and hardfacing.

6. The two-cone drill bit of claim 4, wherein the at least two lug pads are selected such that an annular space of about 15 percent to about 30 percent exists between the two-cone drill bit and a hole wall during drilling.

7. The two-cone drill bit of claim 4, wherein the radial clearance is less than about a ¼ inch.

8. The two-cone drill bit of claim 4, wherein the radial clearance is between about a 1/64 inch and about a ⅛ inch.

9. The two-cone drill bit of claim 1, wherein the plurality of cutting elements is arranged to provide greater than about 17 percent bottom hole coverage per revolution of the two-cone drill bit.

10. The two-cone drill bit of claim 9, wherein the plurality of cutting elements is arranged to provide about 17 to about 25 percent bottom hole coverage per revolution of the two-cone drill bit.

11. The two-cone drill bit of claim 9, wherein the first roller cone and the second roller cone do not intermesh.

12. A two-cone drill bit comprising:

a bit body comprising, a connection adapted to connect to a drill string, a first leg having a first journal formed thereon, and a second leg having a second journal formed thereon;

a first roller cone rotatably mounted on the first journal;

a second roller cone rotatably mounted on the second journal, and a plurality of cutting elements disposed on the first roller cone and the second roller cone, wherein the plurality of cutting elements is arranged to provide greater than about 17 percent bottom hole coverage per revolution of the two-cone drill bit.

13. The two-cone drill bit of claim 12, wherein the plurality of cutting elements is arranged to provide about 17 percent to about 25 percent bottom hole coverage per revolution of the two-cone drill bit.

14. The two-cone drill bit of claim 12, wherein the first roller cone has a cone separation angle of about 145 degrees to about 166 degrees relative to the second roller cone.

15. The two-cone drill bit of claim 14, wherein the cone separation angle is about 155 degrees to about 165 degrees.

16. The two-cone drill bit of claim 14, wherein the cone separation angle is about 163 degrees to about 165 degrees.

17. The two-cone drill bit of claim 12, further comprising:

at least two lug pads disposed on opposing sides of the bit body between the first leg and second leg, wherein a radial clearance of less than about a ½ inch exists between an outer extent of the two lug pads and a gauge diameter of the two-cone drill bit.

18. The two-cone drill bit of claim 17, wherein the at least two lug pads comprise a wear resistant material selected from the group consisting of tungsten carbide, poly-crystalline diamond, and hardfacing.

19. The two-cone drill bit of claim 17, wherein the at least two lug pads are selected such that an annular space of about 15 percent to about 30 percent exists between the two-cone drill bit and a hole wall during drilling.

20. The two-cone drill bit of claim 17, wherein the radial clearance is less than about a ¼ inch.

21. The two-cone drill bit of claim 17, wherein the radial clearance is between about a 1/64 inch and about a ⅛ inch.

22. The two-cone drill bit of claim 13, wherein the first roller cone and the second roller cone do not intermesh.

23. The two-cone drill bit of claim 13, wherein the first roller cone has a positive cone offset and the second roller cone has a negative offset.

24. A two-cone drill bit comprising:

a bit body comprising, a connection adapted to connect to a drill string, a first leg having a first journal formed thereon, and a second leg having a second journal formed thereon;

a first roller cone rotatably mounted on the first journal;

a second roller cone rotatably mounted on the second journal, a plurality of cutting elements disposed on the first roller cone and the second roller cone, and at least two lug pads disposed on opposing sides of the bit body between the first leg and second leg, wherein a radial clearance of less than about a ½ inch exists between an outer extent of the two lug pads and a gauge diameter of the two-cone drill bit, wherein the first roller cone has a cone separation angle of about 145 degrees to about 166 degrees relative to the second roller cone, wherein the plurality of culling elements is arranged to provide greater than about 17 percent hole coverage per revolution of the two-cone drill bit.

25. The two-cone drill bit of claim 24, wherein the plurality of cutting elements is arranged to provide about 17 percent to about 25 percent bottom hole coverage per revolution of the two-cone drill bit.

26. The two-cone drill bit of claim 24, wherein the cone separation angle is about 155 degrees to about 165 degrees.

27. The two-cone drill bit of claim 24, wherein the cone separation angle is about 163 degrees to about 165 degrees.

28. The two-cone drill bit of claim 24, wherein the at least two lug pads comprise a wear resistant material selected from the group consisting of tungsten carbide, poly-crystalline diamond, and hardfacing.

29. The two-cone drill bit of claim 24, wherein the at least two lug pads are selected such that an annular space of about 15 percent to about 30 percent exists between the two-cone drill bit and a hole wall during drilling.

30. The two-cone drill bit of claim 24, wherein the radial clearance is less than about a ¼ inch.

31. The two-cone drill bit of claim 24, wherein the radial clearance is between about a 1/64 inch and about a ⅛ inch.

32. The two-cone drill bit of claim 24, wherein the first roller cone and the second roller cone do not intermesh.

33. The two-cone drill bit of claim 24, wherein the first roller cone has a positive cone offset and the second roller cone has a negative offset.

34. The two-cone drill bit of claim 4, wherein one of the two lug pads has a lug angle of at least about 20 degrees.

35. The two-cone drill bit of claim 34, wherein one of the two lug pads has a lug angle between about 20 degrees and 35 degrees.

36. The two-cone drill bit of claim 17, wherein one of the two lug pads has a lug angle of at least about 20 degrees.

37. The two-cone drill bit of claim 36, wherein one of the two lug pads has a lug angle between about 20 degrees and 35 degrees.

38. The two-cone drill bit of claim 24, wherein one of the two lug pads has a lug angle of at least about 20 degrees.

39. The two-cone drill bit of claim 38, wherein one of the two lug pads has a lug angle between about 20 degrees and 35 degrees.

* * * * *